US008408364B2

(12) United States Patent
Kangas

(10) Patent No.: US 8,408,364 B2
(45) Date of Patent: Apr. 2, 2013

(54) ELEVATOR HOISTWAY SPEED IDENTIFIER WITH MEASURED PROPERTY

(75) Inventor: Petteri Kangas, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/441,122

(22) Filed: Apr. 6, 2012

(65) Prior Publication Data

US 2012/0193171 A1 Aug. 2, 2012

Related U.S. Application Data

(63) Continuation of application No. PCT/FI2010/050786, filed on Oct. 8, 2010.

(30) Foreign Application Priority Data

Oct. 9, 2009 (FI) ..... 20096048

(51) Int. Cl.
*B66B 1/34* (2006.01)

(52) U.S. Cl. ..... 187/393; 187/247

(58) Field of Classification Search ..... 187/247, 187/289, 391–394
See application file for complete search history.

(56) References Cited

U.S. PATENT DOCUMENTS

| | | | | |
|---|---|---|---|---|
| 4,083,430 | A * | 4/1978 | Gingrich | 187/394 |
| 5,821,477 | A * | 10/1998 | Gerstenkorn | 187/394 |
| 5,889,239 | A | 3/1999 | Blackaby et al. | |
| 5,925,859 | A * | 7/1999 | Miller et al. | 187/394 |
| 6,082,498 | A * | 7/2000 | Coste et al. | 187/291 |
| 7,077,244 | B2 * | 7/2006 | Oh et al. | 187/394 |
| 7,533,763 | B2 * | 5/2009 | Kattainen et al. | 187/394 |
| 7,540,358 | B2 * | 6/2009 | Okamoto et al. | 187/394 |
| 7,546,903 | B2 * | 6/2009 | Kattainen et al. | 187/316 |
| 7,597,176 | B2 * | 10/2009 | Zaharia | 187/394 |
| 7,849,975 | B2 * | 12/2010 | Ketonen et al. | 187/394 |
| 7,946,393 | B2 * | 5/2011 | Thumm | 187/393 |
| 7,950,499 | B2 * | 5/2011 | Okamoto et al. | 187/394 |
| 2003/0070883 | A1 | 4/2003 | Foster et al. | |
| 2006/0032711 | A1 | 2/2006 | Marchesi | |
| 2006/0118364 | A1 | 6/2006 | Birrer et al. | |
| 2008/0173502 | A1 | 7/2008 | Tyni et al. | |

FOREIGN PATENT DOCUMENTS

| | | | |
|---|---|---|---|
| EP | 0 661 228 | A2 | 7/1995 |
| WO | 2004/106210 | A1 | 12/2004 |

* cited by examiner

*Primary Examiner* — Anthony Salata
(74) *Attorney, Agent, or Firm* — Birch, Stewart, Kolasch & Birch, LLP

(57) ABSTRACT

The invention relates to a measuring arrangement, an elevator system and also a monitoring arrangement for measuring the movement of an elevator car. The measuring arrangement includes identifiers disposed at set points in the elevator hoistway, each of which identifiers contains at least one property to be measured, which property to be measured is made to be variable in the direction of movement of the elevator car. The measuring arrangement includes at least one measuring apparatus, fitted in connection with the elevator car and arranged to move along with the elevator car in the elevator hoistway. The measuring apparatus is arranged to separately read the property to be measured of each aforementioned identifier after the measuring apparatus has moved in the elevator hoistway to the reading point individual for the identifier to be read.

20 Claims, 3 Drawing Sheets

2A, 2B, 2C, 2D: Identifiers

4: Measuring apparatus

7: Permanently magnetized area

9: Hall sensor

10: RFID tag 2A, 2B, 2C, 2D: Identifiers
4: Measuring apparatus
5: Elevator car
6: Elevator hoistway
11: Acceleration sensor
12: Control
13: Door zone
15, 15': Buffers
16: Hoisting machine
18: Safety gear
21: Monitoring part

ELEVATOR HOISTWAY SPEED IDENTIFIER WITH MEASURED PROPERTY

This application is a Continuation of PCT International Application No. PCT/FI2010/050786 filed on Oct. 8, 2010, which claims the benefit to Patent Application No. 20096048 filed in Finland, on Oct. 9, 2009. The entire contents of all of the above applications is hereby incorporated by reference into the present application.

FIELD OF THE INVENTION

The invention relates to measuring the movement of an elevator car and more particularly to a measuring arrangement, a monitoring arrangement and an elevator system for improving the accuracy of the measured or estimated movement information of an elevator car.

BACKGROUND OF THE INVENTION

The speed of an elevator car in the elevator hoistway is often measured indirectly from the speed of rotation of the hoisting machine of the elevator. In this case a measuring error can arise, e.g. owing to elongation of the elevator ropes; also e.g. slipping of the ropes on the traction sheave of the hoisting machine causes a measuring error. Also the ungoverned movement of the elevator car resulting from breakage of the ropes cannot be detected by measuring the speed of rotation of the hoisting machine. If the position of the elevator car in the elevator hoistway is calculated by integrating the speed of rotation of the hoisting machine, the aforementioned errors of speed measurement are also transferred onwards into the position calculation of the elevator car. The accuracy of the measuring of the movement of the elevator car also affects e.g. the stopping accuracy of the elevator car.

The speed of rotation of the hoisting machine is usually measured with a separate sensor fixed to the hoisting machine, such as with a tachometer or an encoder. As mechanical components, sensors are susceptible to malfunction e.g. owing to vibration, dirt, temperature, etc. In many cases it would thus be advantageous to replace a speed feedback of the hoisting machine made with sensors with a solution that does not contain sensors. In such sensorless solutions the speed of rotation of the hoisting machine is determined e.g. on the basis of electrical magnitudes of the hoisting machine, such as on the basis of motor current and motor voltage. Eliminating sensors may, however, impair the measurement accuracy of the speed of rotation. For example, the rotor slip resultant from the operating principle of an induction motor affects the measurement accuracy of the speed of rotation of the rotor. Also accurate measuring of the speed of rotation of a synchronous motor can be difficult e.g. owing to measuring errors of motor current and motor voltage as well as to interference caused by the operation of a frequency converter.

The speed and position of the elevator car can also be determined e.g. by integrating the acceleration data of the elevator car notified by an acceleration sensor fixed to the elevator car. The aforementioned acceleration data of the elevator car notified by an acceleration sensor generally contains a measuring error to at least some degree, which is then transferred onwards to the speed information and position information of the elevator car.

SUMMARY OF THE INVENTION

The aim of the invention is to eliminate or at least reduce the aforementioned drawbacks. In order to achieve this, a measuring arrangement, a monitoring arrangement and an elevator system are presented in the invention for improving the accuracy of the measured or estimated movement information of the elevator car.

In relation to the characteristic attributes of the invention, reference is made to the claims.

The measuring arrangement according to the invention comprises identifiers disposed at set points in the elevator hoistway, each of which identifiers contains at least one property to be measured, which property to be measured is made to be variable in the direction of movement of the elevator car, and which measuring arrangement comprises at least one measuring apparatus, which measuring apparatus is fitted in connection with the elevator car and which measuring apparatus is arranged to move in the elevator hoistway along with the elevator car, and which measuring apparatus is arranged to separately read the property to be measured of each aforementioned identifier after the measuring apparatus has moved in the elevator hoistway to the reading point individual for the identifier to be read, and in which measuring arrangement the speed of the elevator car in the reading situation of the identifier is determined from the time variation of the property to be measured of the identifier in question.

The elevator system according to the invention comprises, in addition to an elevator car to be moved in the elevator hoistway with the hoisting machine of the elevator, a measuring arrangement, which comprises identifiers disposed at set points in the elevator hoistway, each of which identifiers contains at least one property to be measured, which property to be measured is made to be variable in the direction of movement of the elevator car; and which measuring arrangement comprises at least one measuring apparatus, which measuring apparatus is fitted in connection with the elevator car and which measuring apparatus is arranged to move in the elevator hoistway along with the elevator car, and which measuring apparatus is arranged to separately read the property to be measured of each aforementioned identifier after the measuring apparatus has moved in the elevator hoistway to the reading point individual for the identifier to be read; and in which measuring arrangement the speed of the elevator car in the reading situation of the identifier is determined from the time variation of the property to be measured of the identifier in question. In a preferred embodiment of the invention the elevator system comprises an acceleration sensor, which is disposed in connection with the elevator car. In addition, the elevator system comprises a determination part of the movement of the elevator car, which part is arranged to determine the speed of the elevator car from the measuring signal of the aforementioned acceleration sensor. The determination part of the movement of the elevator car is arranged to modify the speed information of the elevator car determined from the measuring signal of the aforementioned acceleration sensor by means of the speed information of the elevator car determined from the time variation of the property to be measured of an identifier.

The monitoring arrangement according to the invention comprises a measuring arrangement, which comprises identifiers disposed at set points in the elevator hoistway, each of which identifiers contains at least one property to be measured, which property to be measured is made to be variable in the direction of movement of the elevator car; and which measuring arrangement comprises at least one measuring apparatus, which measuring apparatus is fitted in connection with the elevator car and which measuring apparatus is arranged to move in the elevator hoistway along with the elevator car, and which measuring apparatus is arranged to separately read the property to be measured of each aforementioned identifier after the measuring apparatus has moved in the elevator hoistway to the reading point individual for the identifier to be read; and in which measuring arrangement the speed of the elevator car in the reading situation of the identifier is determined from the time variation of the property to be measured of the identifier in question. The monitoring arrangement further comprises a limit value for the maximum permitted speed of the elevator car, and the monitoring arrangement is arranged to compare the speed of the elevator car determined from the time variation of the property to be measured of an identifier disposed at a set point in the elevator hoistway to the limit value for the maximum permitted speed of the elevator car, and the monitoring arrangement is arranged to perform an emergency stop when the speed of the elevator car determined from the time variation of the property to be measured of an identifier exceeds the limit value for the maximum permitted speed.

With the invention one or more of the following advantages, among others, is achieved:

- The measuring arrangement enables an improvement of the determination accuracy of the speed information of the elevator car, because the speed information of the elevator car can be determined accurately in a situation in which the measuring apparatus has moved to the reading point of the identifier in the elevator hoistway.
- The speed information of the elevator car derived from the speed of rotation of the hoisting machine of the elevator can, if necessary, be modified by means of the speed information of the elevator car determined from the time variation of the property to be measured of the identifier; in addition, the position information of the elevator car derived from the speed of rotation of the hoisting machine can, if necessary, be modified by means of the position data of the identifier.
- The speed information and/or position information of the elevator car can also, if necessary, be derived, e.g. by means of one or more electrical magnitudes of the hoisting machine, such as current and/or voltage, from the speed of rotation of the hoisting machine, and this speed information and/or position information of the elevator car derived from the sensorlessly determined speed of rotation of the hoisting machine can be further modified by means of the speed information and/or position information of the elevator car determined by means of an identifier.
- An identifier can contain identification, by means of which the identifiers can be distinguished from each other. The identification can be e.g. an RFID tag fixed to the identifier, and the identification can be read with an RFID reader, which can also be integrated into the measuring apparatus according to the invention.
- The identifiers can be disposed in the elevator hoistway such that by means of an identifier the position of the elevator car in the door zone can be detected. The distance of the reference points contained in an identifier in the direction of movement of the elevator car can also be selected to correspond to the length of the door zone. If the identifiers contain an identification, the different stopping floors can also be specified by means of the identifiers, in which case information about the stopping floors is also retained e.g. over an electricity outage.
- The speed information and/or position information calculated from the measuring signal of the acceleration sensor fitted in connection with the elevator car can also be modified by means of the speed information and/or position information determined by means of an identifier.
- The speed information of the elevator car determined from the time variation of the property to be measured of an identifier can be used in the overspeed monitoring of the elevator car. The limit value for the maximum permitted speed of the elevator car used in overspeed monitoring can also be set for each specific identifier, in which case e.g. limit values of different magnitude for the maximum permitted speed of the elevator car can be used in the overspeed monitoring points that are to be determined according to the position of the identifiers disposed at different points in the elevator hoistway. In this case it is possible e.g. that the identifier-specific limit values for the maximum permitted speed of the elevator car become smaller towards the end of the elevator hoistway.

The aforementioned summary, as well as the additional features and advantages of the invention presented below will be better understood by the aid of the following description of some embodiments, which do not limit the scope of application of the invention.

MORE DETAILED DESCRIPTION OF PREFERRED EMBODIMENTS OF THE INVENTION

Embodiment 1

Figure 1A:
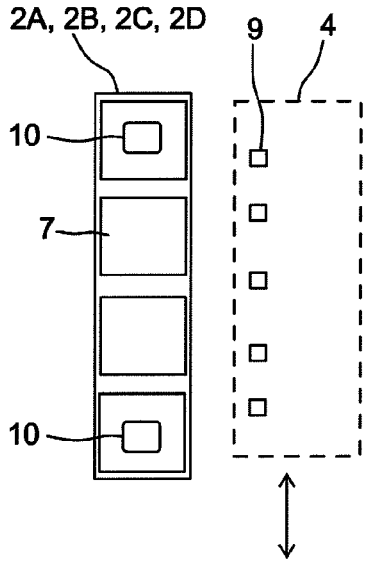
FIGS. 1*a*, 1*b* illustrate a measuring arrangement according to the invention

FIG. 1*a* illustrates a measuring arrangement 1 according to the invention. The measuring arrangement comprises identifiers 2A, 2B, 2C, 2D, which are disposed at set points in the elevator hoistway. Each of the identifiers 2A, 2B, 2C, 2D comprises four permanently-magnetized areas 7 fitted consecutively, the magnetic poles of two of which consecutive permanently magnetized areas are of opposite directions to each other, producing magnetic fields that are of opposite directions.

Figure 1B:
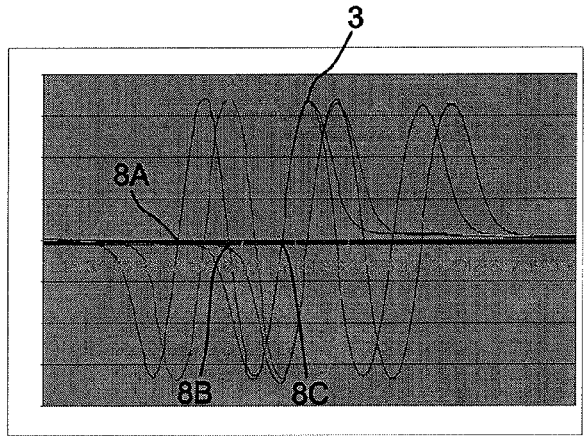

The measuring arrangement 1 also comprises a measuring apparatus 4, which is disposed in connection with the elevator car and is arranged to move along with the elevator car in the elevator hoistway such that the path of movement of the measuring apparatus passes the aforementioned identifiers 2A, 2B, 2C, 2D at close range. The measuring apparatus 4 has five Hall sensors 9 that read a magnetic field 3. When the measuring apparatus 4 arrives in the proximity of the identifier 2A, 2B, 2C, 2D, the Hall sensors 9 of the measuring apparatus register a change in the magnetic field 3. When the measuring apparatus 4 moves past the identifier 2A, 2B, 2C, 2D in the direction of the arrow marked in FIG. 1*a*, each of the Hall sensors 9 forms a proportional signal to the magnetic field 3 of the identifier 2A, 2B, 2C, 2D in relation to the position according to FIG. 1*b*. The phase difference between the signals in FIG. 1*b* is caused by the correlative placement of the Hall sensors. Since the signals of FIG. 1*b* are essentially sinusoidal in relation to the position, the instantaneous linear position of the elevator car at the reading point of the identifier can be determined on the basis of the aforementioned instantaneous values of the signals that are proportional to the magnetic field 3, e.g. with trigonometric calculations.

In the identifier 2A, 2B, 2C, 2D the size of each permanently magnetized area 7 is 40 mm×30 mm. The areas are situated consecutively in the direction of movement of the elevator car such that the distance between the center points of consecutive areas is 48 mm. The Hall sensors 9 are fitted to the measuring apparatus 4 consecutively in the direction of movement of the elevator car such that the distances between two consecutive sensors 9 are 24 mm, 36 mm, 36 mm, 24 mm, respectively, starting from the edgemost. The Hall sensors 9 in FIG. 1*a* are disposed next to the identifier 2A, 2B, 2C, 2D for the sake of clarity.

By means of the arrangement according to FIG. 1*a* the mutual distances between the zero points 8A, 8B, 8C of the signals marked in FIG. 1*b* that are proportional to the magnetic field 3 are formed such that the distance between two consecutive zero points 8A, 8B; 8B, 8C is 48 mm and therefore the distance between the edgemost zero points 8A, 8C is 96 mm. The speed of the elevator car in the elevator hoistway is determined by measuring the time that it takes for the elevator car to travel the distance between the aforementioned edgemost zero points. The measurement accuracy can also be improved e.g. by determining separately the travel times of the distance between two consecutive zero points 8A, 8B; 8B, 8C and by calculating the average of them.

An RFID tag 10 is also fixed to the identifier 2A, 2B, 2C, 2D of FIG. 1*a*, which tag contains identifier-specific identification. By means of the identification, the identifier in question can be distinguished from the other identifiers.

Instead of Hall sensors 9 e.g. magnetoresistive sensors could also be used in measuring the magnetic field.

The number and mutual placement of the permanently-magnetized areas 7 and of the Hall sensors 9 can also be selected in many different ways. Also the size of the permanently-magnetized areas 7 can vary. In this case the mutual placement and the number of the zero points 8A, 8B, 8C of a signal proportional to the magnetic field 3 can vary.

The speed of the elevator car at the measuring point of an identifier 2A, 2B, 2C, 2D could also be determined from the mutual time variation between the aforementioned measuring signals of at least two different Hall sensors 9.

Embodiment 2

Figure 2:
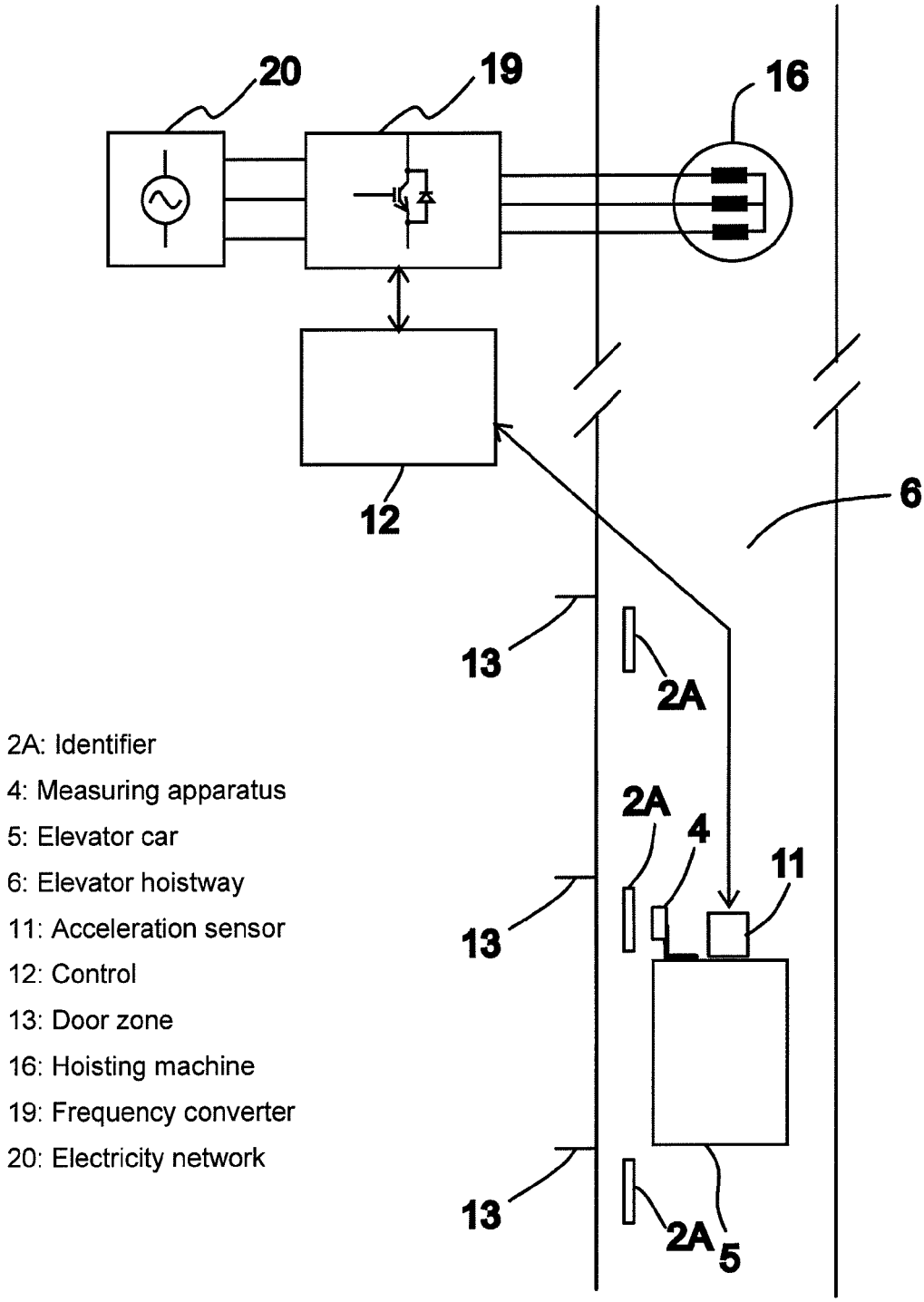
FIG. 2 presents an elevator system according to the invention, as a block diagram

FIG. 2 presents as a block diagram an elevator system, which comprises an elevator car 5 to be moved in the elevator hoistway 6 with the hoisting machine 16 of the elevator. The elevator car 5 is suspended in the elevator hoistway 6 with elevator ropes (not shown in figure) passing via the traction sheave of the hoisting machine 16 of the elevator. The hoisting machine 16 of the elevator moves the elevator car 5 in the elevator hoistway 6 essentially in the vertical direction between stopping floors. A frequency converter 19 drives the hoisting machine 16 of the elevator by regulating the power supply between the electricity network 20 and the hoisting machine 16. Control of the movement of the elevator car occurs with the elevator controller 12, as a response to calls sent from the stopping floors as well as from the elevator car 5. The frequency converter 19 adjusts the speed of rotation of the hoisting machine 16 to correspond to the reference value for speed set by the elevator control 12. The elevator control 12 determines the position and speed of the elevator car 5 in the elevator hoistway 6 by integrating the measuring signal of the acceleration sensor 11 fitted in connection with the roof of the elevator car. The integration produces a creeping error in both the speed information and the position information of the elevator car.

A measuring apparatus 4 is fixed in connection with the roof of the elevator car 5 with fixing means. The identifiers 2A are disposed at set points in the elevator hoistway 6. The measuring apparatus 4 and the identifiers 2A are disposed with respect to each other such that when the measuring apparatus 4 moves along with the elevator car 5 in the elevator hoistway, the path of movement of the measuring apparatus 4 passes the aforementioned identifiers 2A at close range. The identifiers 2A are e.g. fixed to the guide rail (not shown in figure) of the elevator car in connection with the stopping floors to indicate the position of the elevator car 5 in the door zone 13 of a stopping floor. The measuring apparatus 4 is arranged to read the property to be measured of an identifier after the measuring apparatus 4 has moved to the reading point of the identifier 2A in the immediate proximity of the identifier. In the situation of FIG. 2 the elevator car 1 is situated in the door zone 13 of a stopping floor, in which case the floor of the elevator car is on essentially the same level with the floor of the stopping floor, and moving into the elevator car and out of the elevator car is trouble-free. In this case the measuring apparatus 4 and the identifier 2A that indicates the door zone 13 of a stopping floor are disposed facing each other according to FIG. 2. The length of the door zone in the direction of movement of the elevator car can be e.g. approx. 30 centimeters.

Each of the identifiers 2A contains at least one property to be measured, which is made to be variable in the direction of movement of the elevator car. The measuring apparatus 4 determines the speed of the elevator car 5 in the reading situation of the identifier 2A from the time variation of the property to be measured of the identifier in question and also sends the determined speed information to the control 12 of the elevator. The measuring apparatus 4 also sends to the control 12 of the elevator a positioning signal immediately when the measuring apparatus 4 arrives at the reading point of the identifier. By means of the positioning signal, the absolute position of the elevator car in the elevator hoistway can be determined because the reading point of an identifier is individual and invariable for each identifier.

The control 12 of the elevator modifies the speed information of the elevator car calculated from the measuring signal of the acceleration sensor 11 of the elevator car by means of the speed information of the elevator car determined from the time variation of the property to be measured of the identifier 2A always when the measuring apparatus 4 moves to the point of the next identifier 2A in the elevator hoistway 6. Likewise, the control 12 of the elevator modifies the position information of the elevator car calculated from the measuring signal of the acceleration sensor 11 with the position data of the identifier 2A transmitted by the positioning signal always when the measuring apparatus 4 arrives at the point of the next identifier 2A in the elevator hoistway 6.

In this embodiment of the invention, each of the identifiers 2A contains at least two reference points to be measured, the distance from each other of which reference points in the direction of movement of the elevator car 5 is set. The identifiers can be e.g. of the type described in embodiment 1; on the other hand, the property to be measured of an identifier, which property is variable in the direction of movement of the elevator car, can also be based on e.g. variable electromagnet radiation, variable inductance, a variation in sound waves or a variation in the reflection of electromagnet radiation, in addition to being based on a magnetic field variable in the longitudinal direction of an identifier 2A. The property to be measured/measuring apparatus can also be duplicated; the duplication can also be made by including two different properties to be measured in the same identifier, both of which properties vary in the direction of movement of the elevator car. The measuring apparatus 4 can also measure a property to be measured of an identifier 2A with at least two different sensors, and the speed of the elevator car at the measuring point of an identifier 2A could be determined from the time variation between the measuring signals describing the property to be measured of an identifier of the aforementioned at least two different sensors.

Embodiment 3

Figure 3A:
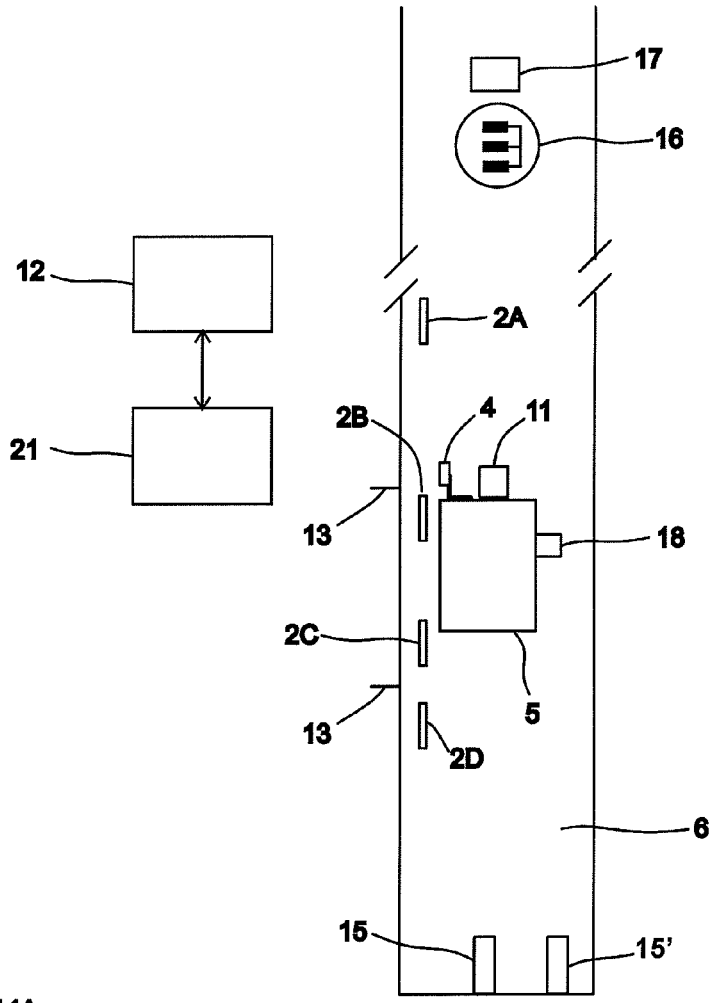
FIG. 3*a* presents a monitoring arrangement according to the invention, as a block diagram

FIG. 3*a* presents as a block diagram a monitoring arrangement according to the invention for monitoring the movement of the elevator car. In FIG. 3*a* only the bottom part of the elevator hoistway 6 with its bottom end zone is described, and additionally the hoisting machine 16 disposed in the top part of the elevator hoistway, and the machinery brake 17 of the hoisting machine. The elevator arrangement of FIG. 3*a* comprises an elevator car 5 to be moved in the elevator hoistway 6 with the hoisting machine 16 of the elevator. The elevator car 5 is suspended in the elevator hoistway 6 with elevator ropes (not shown in figure) passing via the traction sheave of the hoisting machine 16 of the elevator. The hoisting machine 16 of the elevator moves the elevator car 5 in the elevator hoistway 6 essentially in the vertical direction between stopping floors. A frequency converter (not shown in figure) drives the hoisting machine 16 of the elevator by regulating the power supply between the electricity network and the hoisting machine 16. Control of the movement of the elevator car occurs with the elevator controller 12, as a response to calls sent from the stopping floors as well as from the elevator car 5. The frequency converter adjusts the speed of rotation of the hoisting machine 16 to correspond to the reference value for speed set by the elevator control 12. When the elevator car stops at a stopping floor, the control 12 of the elevator activates the machinery brake 17, which locks the traction sheave of the hoisting machine 16 into its position during the standstill of the elevator. The same machinery brake 17 is also used as the emergency brake of the elevator, which brake is activated to brake the movement of the elevator car 5 in connection with an emergency stop. In addition, the elevator system comprises a separate wedge brake, i.e. a safety gear 18, which is used in addition to the machinery brake 17 as an emergency brake to prevent ungoverned movement of the elevator car 5. Since the safety gear engages directly between the elevator car 5 and the guide rail (not shown in figure) to brake the movement of the elevator car 5, by means of the safety gear also ungoverned movement of the elevator car caused by e.g. breakage of the elevator ropes can be prevented.

A measuring apparatus 4 is fixed in connection with the roof of the elevator car 5 with fixing means. The identifiers 2A, 2B, 2C, 2D are disposed at set points in the elevator hoistway 6. The measuring apparatus 4 and the identifiers 2A, 2B, 2C, 2D are disposed with respect to each other such that when the measuring apparatus 4 moves along with the elevator car 5 in the elevator hoistway, the path of movement of the measuring apparatus 4 passes the aforementioned identifiers 2A, 2B, 2C, 2D at close range. The identifiers 2A, 2B are e.g. fixed to the guide rail (not shown in figure) of the elevator car in connection with the stopping floors to indicate the position of the elevator car 5 in the door zone 13 of a stopping floor. In addition, two identifiers 2C, 2D are disposed in the end zone of the elevator hoistway.

An RFID tag is fixed to each identifier 2A, 2B, 2C, 2D, which tag contains the identification of the identifier. By means of the identification, an identifier 2A, 2B, 2C, 2D can be distinguished from the other identifiers 2A, 2B, 2C, 2D. A reader of the RFID tag is integrated into the measuring apparatus, in which case the measuring apparatus is able to identify each of the identifiers 2A, 2B, 2C, 2D by reading the RFID tag of the identifier.

Each of the identifiers 2A, 2B, 2C, 2D contains at least one property to be measured, which is made to be variable in the direction of movement of the elevator car 5. The measuring apparatus 4 is arranged to read the property to be measured of an identifier after the measuring apparatus 4 has moved to the reading point of the identifier 2A, 2B, 2C, 2D in the immediate proximity of the identifier. The measuring apparatus 4 determines the speed of the elevator car 5 in the reading situation of the identifier 2A, 2B, 2C, 2D from the time variation of the property to be measured of the identifier in question and also sends the determined speed information to the monitoring part 21 of the movement of the elevator car. In addition, the measuring apparatus 4 sends the identification data of the identifier to the monitoring part 21 of movement. The monitoring part 21 of movement compares the speed of the elevator car 5 determined from the time variation of the property to be measured of an identifier 2A, 2B, 2C, 2D to the limit value for the maximum permitted speed of the elevator car. The monitoring arrangement performs an emergency stop when the speed of the elevator car determined from the time variation of the property to be measured of an identifier exceeds the limit value 14A, 14B, 14C, 14D for the maximum permitted speed.

Figure 3B:
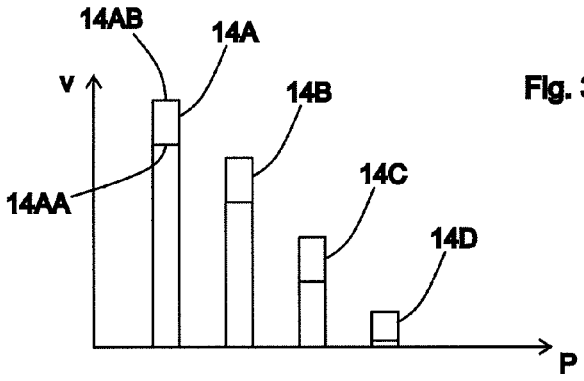
FIG. 3*b* presents the limit values for the maximum permitted speed in a monitoring arrangement according to the invention.

The limit value 14A, 14B, 14C, 14D for the maximum permitted speed of the elevator car is set for each specific identifier such that the limit values 14A, 14B, 14C, 14D for the maximum permitted speed that is applicable to different identifiers and that is set specifically for each identifier become smaller towards the bottom end P of the elevator hoistway 6 in the manner presented in FIG. 3*b*. The limit value 14A marked in FIG. 3*b* applies to the identifier 2A of FIG. 3*a*, which identifier is disposed in connection with a stopping floor other than the terminal floor to indicate the position of the elevator car 5 in the door zone 13 of a stopping floor other than the terminal floor. The limit value 14B, on the other hand, applies to the identifier 2B, which is disposed in connection with the terminal floor to indicate the position of the elevator car 5 in the door zone 13 of the terminal floor. The limit value 14C applies to the identifier 2C, which is disposed to be the next when moving from the identifier 2B that indicates the door zone of a terminal floor towards the bottom end P of the elevator hoistway. The limit value 14D applies to the identifier that is disposed closest to the bottom end P of the elevator hoistway. According to FIG. 3*b*, the identifier-specific limit values 14A, 14B, 14C, 14D for the aforementioned maximum permitted speeds become smaller towards the bottom end P of the elevator hoistway, in which case the limit value 14D for the maximum permitted speed applicable to the identifier 2D that is to be disposed closest to the bottom end P of the elevator hoistway and that indicates the position of the elevator car in the bottom end zone permits movement of the elevator car at only an essentially small speed v, in which case also the kinetic energy of the elevator car 5 remains so small that the dimensioning of the buffer 15 disposed in the bottom end P at the point of the elevator car 5 can be made smaller. In this case also the length of the safety spaces of the bottom end zone in the direction of movement of the elevator car can be shortened, which improves the space efficiency of the elevator system.

The monitoring part 21 of movement connects the limit value for the maximum permitted speed of the elevator car to be used at that time to the correct identifier 2A, 2B, 2C, 2D by means of the identification data of the identifier sent by the measuring apparatus 4.

The monitoring part of the movement of the elevator car compares the speed v of the elevator car determined from the time variation of an identifier 2A, 2B, 2C, 2D to the dual-level limit value 14A, 14B, 14C, 14D for the maximum permitted speed applicable to the same identifier. The principle of a dual-level limit value is illustrated in more detail here in connection with the limit value 14A. If the speed v of the elevator car in this case exceeds the first level 14AA of the limit value but remains smaller than the second level 14AB of the limit value, the monitoring part 21 of movement performs an emergency stop by controlling the machinery brake 17 of the hoisting machine and also by disconnecting the power supply to the hoisting machine 16 of the elevator. If the speed v of the elevator car, however, also exceeds the second level 14AB of the limit value, the monitoring part 21 of movement additionally also controls the safety gear 18, which thus ensures the emergency stop of the elevator car 5.

FIG. 3*a* describes the placement of the identifiers 2A, 2B, 2C, 2D in the bottom part and in the bottom end zone of the elevator hoistway. The identifiers 2A, 2B, 2C, 2D can if necessary, however, also be disposed in the top part and in the top end zone of the elevator hoistway in such a corresponding manner that the limit values 14A, 14B, 14C, 14D for the maximum permitted speed that are applicable to different identifiers and that are set specifically for each identifier become smaller towards the top end of the elevator hoistway 6. In this case also at least one of the limit values 14C, 14D for the maximum permitted speed of the elevator car 5 that is applicable to the identifier 2C, 2D that is disposed in the top end zone of the elevator hoistway and/or that indicates the position of the elevator car in the top end zone can be set to be so small that the collision energy of the counterweight with respect to the end buffer 15' fitted to the bottom end at the point of the counterweight becomes essentially smaller, in which case also the dimensioning of the end buffer 15' fitted to the point of the counterweight can be made smaller. The identification of the identifiers in embodiment 3 is implemented using RFID tags; the identification of the identifiers can, however, occur also in some other ways, e.g. by varying the shape of the magnets of the identifiers and/or the mutual placement of the identifiers and/or the number of the magnetic areas and/or the length of the magnetic areas in the direction of movement of the elevator car.

The invention is described above by the aid of a few examples of its embodiment. It is obvious to the person skilled in the art that the invention is not limited only to the embodiments described above, but that many other applications are possible within the scope of the inventive concept defined by the claims presented below.

It is obvious to the person skilled in the art that the elevator system according to the invention can be provided with a counterweight or can be one without a counterweight.

It is further obvious to the person skilled in the art that the elevator system according to the invention can comprise more than one elevator car fitted into the same elevator hoistway. In this case the measuring apparatus according to the invention can be fitted in connection with more than one elevator car fitted into the same elevator hoistway.

It is additionally obvious to the person skilled in the art that the measuring apparatus according to the invention can be fixed in connection with the mechanics that moves along with the elevator car, such as in connection with the sling of the elevator car or e.g. the counterweight.

It is also obvious to the person skilled in the art that more identifiers can be disposed in the elevator hoistway in a corresponding manner, for improving measuring precision and monitoring precision.

The invention claimed is:

1. A measuring arrangement for measuring movement of an elevator car, the measuring arrangement comprising:

identifiers disposed at set points in the elevator hoistway, each of the identifiers containing at least one property to be measured, the property to be measured being made to be variable in a direction of the movement of the elevator car;

a plurality of RFID tags, each of the RFIDs being fixed to a corresponding one of the identifiers and containing identifier-specific identification of the corresponding one of the identifiers; and at least one measuring apparatus, the measuring apparatus being fitted in connection with the elevator car and the measuring apparatus being arranged to move in the elevator hoistway along with the elevator car, the measuring apparatus being to separately read the property to be measured of each of the identifiers after the measuring apparatus has moved in the elevator hoistway to the reading point individual for the identifier to be read;

wherein the speed of the elevator car in the reading situation of the identifier is determined from the time variation of the property to be measured of the identifier in question.

2. The measuring arrangement according to claim 1, wherein the identifier contains at least two reference points to be measured, the distance from each other of the reference points in the direction of movement of the elevator car is set.

3. The measuring arrangement according to claim 2, wherein the speed of the elevator car is determined by measuring the time that it takes for the elevator car to travel the distance between the aforementioned reference points.

4. The measuring arrangement according to claim 1, wherein the measuring apparatus comprises means for measuring a magnetic field, and wherein the identifier comprises permanently-magnetized areas fitted consecutively, the magnetic poles of two of the consecutive permanently magnetized areas are of opposite directions to each other, and the consecutive permanently-magnetized areas are arranged at a determined distance from each other in the direction of movement of the elevator car.

5. The measuring arrangement according to claim 4, wherein the speed of the elevator car is determined by measuring the time that it takes for the elevator car to travel the distance between the zero points of the magnetic field produced by the permanently-magnetized areas of the aforementioned identifier.

6. An elevator system, which comprises an elevator car to be moved in the elevator hoistway with the hoisting machine of the elevator, wherein the elevator system comprises the measuring arrangement according to claim 1 for measuring the movement of the elevator car.

7. The elevator system according to claim 6, wherein the elevator system comprises a determination part of the movement of the elevator car, and the determination part of movement is arranged to determine the speed of the elevator car from the speed of rotation of the hoisting machine of the elevator, and wherein the determination part of the movement of the elevator car is arranged to modify the speed information of the elevator car determined from the speed of rotation of the hoisting machine of the aforementioned elevator by means of the speed information of the elevator car determined from the time variation of the property to be measured of an identifier.

8. The elevator system according to claim 7, wherein the determination part of the movement of the elevator car is arranged to determine the position of the elevator car in the elevator hoistway from the speed of rotation of the hoisting machine of the elevator, and wherein the determination part of the movement of the elevator car is arranged to modify the aforementioned position information of the elevator car determined from the speed of rotation of the hoisting machine of the elevator by means of the position data of an identifier.

9. The elevator system according to claim 6, wherein the elevator system comprises an acceleration sensor, which is disposed in connection with the elevator car, wherein the elevator system comprises a determination part of the movement of the elevator car, and the determination part of movement is arranged to determine the speed of the elevator car from the measuring signal of the aforementioned acceleration sensor, and wherein the determination part of the movement of the elevator car is arranged to modify the speed information of the elevator car determined from the measuring signal of the aforementioned acceleration sensor by means of the speed information of the elevator car determined from the time variation of the property to be measured of an identifier.

10. The elevator system according to claim 9, wherein the determination part of the movement of the elevator car is arranged to determine the position of the elevator car in the elevator hoistway from the measuring signal of the aforementioned acceleration sensor, and wherein the determination part of the movement of the elevator car is arranged to modify the position information of the elevator car determined from the measuring signal of the aforementioned acceleration sensor by means of the position data of an identifier.

11. The elevator system according to claim 6, wherein an identifier is disposed in the elevator hoistway to indicate the position of the elevator car in the door zone.

12. The monitoring arrangement according to claim 1 further comprising:

a limit value for the maximum permitted speed of the elevator car, wherein the monitoring arrangement is arranged to compare the speed of the elevator car determined from the time variation of the property to be measured of an identifier disposed at a set point in the elevator hoistway to the limit value for the maximum permitted speed of the elevator car, and the monitoring arrangement is arranged to perform an emergency stop when the speed of the elevator car determined from the time variation of the property to be measured of an identifier exceeds the limit value for the maximum permitted speed.

13. The monitoring arrangement according to claim 12, wherein the aforementioned limit value for the maximum permitted speed of the elevator car is set for each specific identifier such that at least two different identifiers have a limit value of a different magnitude for the maximum permitted speed that is applicable to a certain identifier, and wherein the monitoring arrangement is arranged to compare the speed of the elevator car determined from the time variation of the property to be measured of an identifier to the limit value for the maximum permitted speed applicable to the same identifier.

14. The monitoring arrangement according to claim 13, wherein the aforementioned identifiers are disposed in the elevator hoistway in the direction of movement of the elevator car such that the limit values for the maximum permitted speed that are applicable to different identifiers and are set for each specific identifier become smaller towards the end of the elevator hoistway.

15. The monitoring arrangement according to claim 12, wherein the identifiers are disposed in the elevator hoistway to indicate the position of the elevator car in the door zone.

16. The monitoring arrangement according to claim 13, wherein at least one identifier is disposed in the end zone of the elevator hoistway, and wherein the limit value for the maximum permitted speed of the elevator car applicable to the aforementioned identifier disposed in the end zone of the elevator hoistway is set to be essentially small, to minimize the collision energy of the elevator car in order to make the dimensioning of the end buffer smaller.

17. The monitoring arrangement according to claim 13, wherein at least one identifier is disposed to indicate the position of the elevator car in the end zone, and wherein the limit value for the maximum permitted speed of the elevator car applicable to the aforementioned identifier that indicates the position of the elevator car in the end zone of the elevator hoistway is set to be essentially small, to minimize the collision energy of the elevator car in order to make the dimensioning of the end buffer-smaller.

18. The monitoring arrangement according to claim 2, wherein the measuring apparatus comprises means for measuring a magnetic field, and the identifier comprises permanently-magnetized areas fitted consecutively, the magnetic poles of two of the consecutive permanently magnetized areas are of opposite directions to each other, and the consecutive permanently-magnetized areas are arranged at a determined distance from each other in the direction of movement of the elevator car.

19. The monitoring arrangement according to claim 3, wherein the measuring apparatus comprises means for measuring a magnetic field, and the identifier comprises permanently-magnetized areas fitted consecutively, the magnetic poles of two of the consecutive permanently magnetized areas are of opposite directions to each other, and the consecutive permanently-magnetized areas are arranged at a determined distance from each other in the direction of movement of the elevator car.

20. The monitoring arrangement according to claim 1, wherein the measuring apparatus includes a plurality of Hall sensors, at least a distance between two immediately adjacent Hall sensors is different from a distance between another two immediately adjacent Hall sensors.

* * * * *